United States Patent [19]

Yax

[11] Patent Number: 4,503,613

[45] Date of Patent: Mar. 12, 1985

[54] METHOD FOR EDGE GRINDING MULTIFACETED LENSES

[75] Inventor: Michael J. Yax, Rochester, N.Y.

[73] Assignee: Textron, Inc., Providence, R.I.

[21] Appl. No.: 475,331

[22] Filed: Mar. 14, 1983

[51] Int. Cl.[3] ..... B24B 9/14

[52] U.S. Cl. ..... 51/284 E; 51/101 LG; 409/104; 409/123

[58] Field of Search ..... 51/101 R, 101 LG, 105 LG, 51/106 LG, 127, 283 E, 284 R, 284 E; 409/104, 122, 123, 130

[56] References Cited

U.S. PATENT DOCUMENTS

| | | | |
|---|---|---|---|
| 2,321,383 | 6/1943 | Harper | 51/101 LG |
| 3,105,302 | 10/1963 | Novak | 51/101 LG X |
| 3,461,619 | 8/1969 | Hurlbut et al. | 51/101 LG X |
| 3,513,598 | 5/1970 | Asselin et al. | 51/101 LG |
| 3,587,192 | 6/1971 | Schnellman | 51/127 X |
| 3,828,648 | 8/1974 | Geula | 51/101 LG X |
| 4,005,551 | 2/1977 | Lines | 51/101 R |
| 4,394,099 | 7/1983 | Santinelli | 51/101 LG X |

*Primary Examiner*—Robert P. Olszewski

*Attorney, Agent, or Firm*—Shlesinger, Fitzsimmons & Shlesinger

[57] ABSTRACT

A first pattern, which has on its outer periphery a series of intersecting surfaces, is used in a conventional edger unit to control the rough grinding of a corresponding series of intersecting surfaces on the edge of a revolving lens blank. A second pattern is then inserted in the edger to control a first bevel grinding operation during which a bevel grinding wheel is caused intermittently to engage the revolving lens blank to form thereon a first plurality of angularly spaced, beveled surfaces at least one of which registers with one of the intersecting surfaces on the blank. A third pattern is then inserted in the edger to control a second bevel grinding operation during which the bevel grinding wheel forms a second plurality of beveled surfaces on the lens blank in the spaces between the first plurality, and in registry with the remainder of said flat surfaces on the blank. The result is the formation of a series of intersecting beveled surfaces having very sharp corners or facets formed at their intersections.

8 Claims, 7 Drawing Figures

METHOD FOR EDGE GRINDING MULTIFACETED LENSES

BACKGROUND OF THE INVENTION

This invention relates to spectacle lenses, and more particularly to an improved method for grinding the edges of such lenses to form thereon intersecting beveled edges which have extremely sharp corners or facets.

It has become fashionable to wear spectacle frames which are attached only to their associated lenses at spaced points. In other words, instead of extending completely around and enclosing outer, marginal edges of each lens, the frame is fastened to each lens at only a few points. The purpose, of course, is to leave substantial portions of the outer peripheral surace of each lens exposed. This permits the exposed edges of the lenses to be ground in various configurations designed to flatter or embellish the facial features of the person wearing the spectacles.

Spectacles of this type that have become particularly popular are those using lenses which have substantial portions of their forward edges beveled. Even more popular are the lenses which have been ground to form along their upper edges of plurality of intersecting, beveled surfaces. Most desirably these points of intersection of the beveled surfaces form sharp corners, which therefore provide the appearance of the facets of a gem.

Unfortunately, however, it has been extremely difficult and expensive to form the desirably sharp corners between intersecting beveled edges on multifaceted lenses of the type described. Heretofore it has been the practice to grind the intersecting, beveled edges on the upper end of a lens in a single operation, and the result has been the formation of a rather rounded corner at the intersection of adjacent surfaces. The two surfaces must then be hand ground to remove from each a quantity of glass or plastic sufficient to generate between them a sharp, well-defined edge or corner. Because of the time and labor involved in forming such sharp corners, these multifaceted lenses heretofore have been extremely expensive to produce.

It is an object of this invention, therefore, to provide an improved method and means which considerably reduce the cost of producing sharp-cornered, multifacted spectacle lenses of the type described.

Another object of this invention is to provide an improved method of the type described which eliminates the need for manual operations in producing multifaceted lenses for spectacle frames.

Still another object of this invention is to provide an improved series of lens formers which permit the rapid and accurate grinding of intersecting beveled edges on lens blanks of the type described, and in such manner that the intersections are defined by extremely sharp corners.

Other objects of the invention will be apparent hereinafter from the specification and from the recital of the appended claims, particularly when read in conjunction with the accompanying drawings.

SUMMARY OF THE INVENTION

Three separate lens formers or patterns are used in conjunction with a conventional lens edge unit in order to edge grind or multifaceted lens in three separate operations. The first pattern is placed in the edger to effect the usual rough grinding of a lens blank by use of a rough wheel. When this is complete, the flat surface of a compound flat-bevel grinding wheel is used to finish grind the outer periphery of the blank.

Thereafter the first of two bevel edging patterns is then substituted in place of the first pattern. The bevel grinding surface of the compound wheel is then engaged with the blank under control of the second pattern, and in such manner that three, spaced, beveled surfaces are ground on the edge of the lens blank along its upper and opposite side surfaces, respectively. The third pattern is then substituted for the second and causes the same bevel grinding surface to grind two more, spaced, beveled surfaces on the lens blank in the two spaces which separate the three beveled surfaces formed by the second pattern. These last two beveled surfaces intersect the first three surfaces along sharp edges or corners which form the desired facets.

THE DRAWINGS

DETAILED DESCRIPTION OF THE PREFERRED EMBODIMENTS

Figure 1:
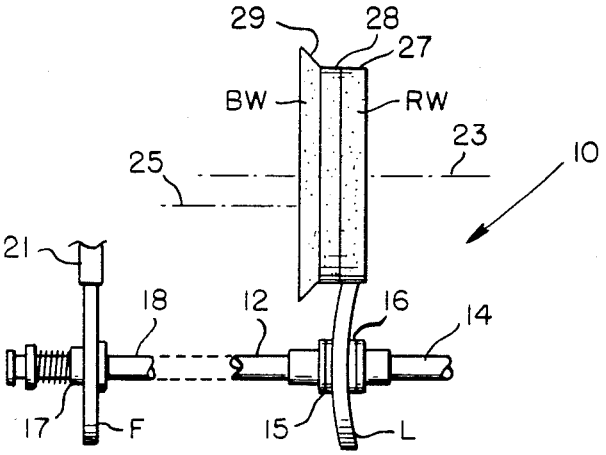
FIG. 1 is a fragmentary elevational view illustrating diagramatically part of a conventional lens edger unit, or edge grinding machine, which can be employed to perform a novel edge grinding process in accordance with this invention.

Referring now to the drawings by numerals of reference, and first to FIG. 1, 10 denotes generally portions of a conventional edger unit, or edge grinding machine, which comprises a driven tail spindle 12 and a rotatable clamp spindle 14 that is mounted to rotate in coaxial, confronting relation to spindle 12. The confronting ends of spindle sections 12 and 14 have thereon resilient clamping pads 15 and 16, respectively, between which a lens blank L is adapted to be releasably clamped in a known manner. Releasably secured by a spring clamp 17, or the like, to an extension 18 of spindle 12 is a pattern element or former F, which is engaged by a conventional sizing dial 21. Mounted to rotate about an axis 23 that extends parallel to the spindles 12 and 14 are two grinding wheels RW (roughing wheel) and BW (beveling wheel), respectively. As will be apparent to those skilled in the art, the wheels BW and RW are also mounted to be swung in unison during an edging operation about a further axis 25 by the sizing dial 21, which controls the engagement of one of the grinding wheels with the edge of the lens blank L that is clamped between the spindle sections 12 and 14.

Although the edger unit has not been illustrated and described in detail herein, it will be understood from the hereinafter described process that any one of a variety of conventional edger units can be utilized to form a multifaceted lens in accordance with the applicant's invention. By way of example, a typical such unit may be the type known as the Shuron (Weco) 463 A/B diamond bevel edger. The roughing wheel RW may be of the conventional type having a flat, circumferential working or grinding surface 27. The bevel wheel may be the ASCO "TURA TYPE" bevel wheel, which has a compound grinding surface comprising a flat, finish grinding section 28, and a bevel grinding section 29.

Figure 2:
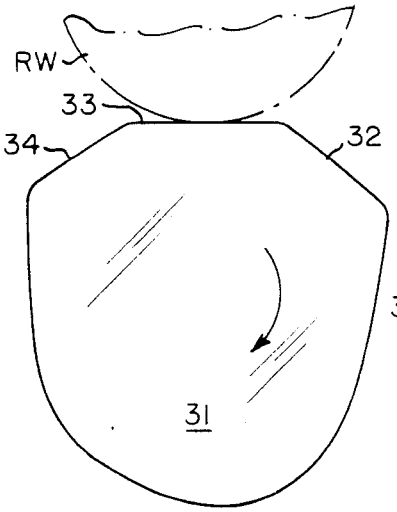
FIGS. 2 and 3 are elevational views of a multifaceted spectacle lens as it appears after each of two edge grinding operations have been performed thereon in accordance with a conventional two former or two operation system.
Figure 3:
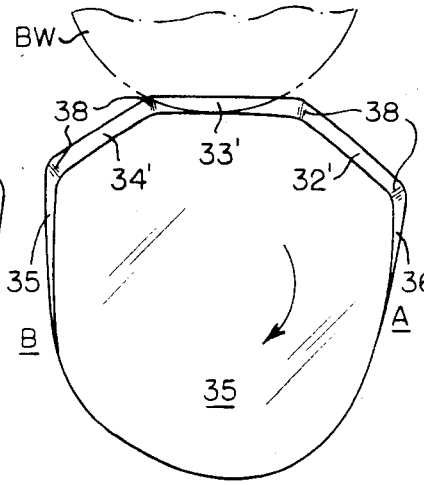
Figure 4:
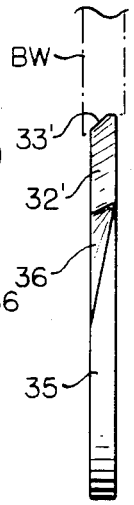
FIG. 4 PRIOR ART
FIG. 4 is a side elevational view of the lens shown in FIG. 3.

Referring now to FIGS. 2 to 4, it heretofore has been conventional practice in the production of faceted lenses to rough grind a lens blank L into a configuration generally similar to that of the lens denoted at 31 in FIG. 2. During this roughing operation the wheel RW is used under the control of a first former F, which has a configuration substantially identical to that of the lens 31. The former F, and consequently the lens 31, are each provided along the upper edges thereof with three, intersecting surface 32, 33 and 34.

After the lens blank has been rough ground, the roughing wheel RW is shifted laterally out of the registry with the lens blank L in a known manner, and is replaced by a finishing wheel, such as for example the compound bevel wheel BW (broken lines in FIGS. 3 and 4). The blank is then engaged and finish ground by the flat surface 28 on the compound wheel BW to the exact configuration denoted at 31 in FIG. 2. During this finish grinding step the wheel BW is under the control of the same former F used for rough grinding.

Thereafter the first former F is replaced by a second former or pattern which has an outer configuration similar to that of the finished lens 35 (FIG. 3), except that it does not have thereon any beveled surfaces. The bevel grinding surface 29 on wheel BW is then shifted into engagement with the edge of lens 31, and a single stage bevel grinding operation is now commenced under control of the second former F. As the lens 31 rotates the wheel BW begins the uninterrupted grinding of a beveled surface commencing, for example, at the point A (FIG. 3) on the edge of lens 31 and extending continuously around the upper edge of the lens to the point B (FIG. 3).

During this final operation the second pattern or former F not only causes the surfaces 32, 33, and 34 to be beveled as at 32', 33', 34', it also forms beveled surfaces 35 and 36 (FIG. 3) at opposite sides of the lines. Moreover, this operation has the undesirable result of rounding as at 38 the corners which had been formed at opposite ends of the edge sections 32, 33 and 34 by the previous grinding operations. Consequently, although the final lens 35 does have beveled surfaces, and although the surfaces are inclined to each other, there are not sharp corners or facets formed at opposite ends of each beveled section. In order to eliminate these round corners 36 and to provide in their places sharp, intersecting facets, it is necessary in the field for an optometrist or the like manually to grind down each of the beveled surfaces 32', 33' and 34', slightly further, and in such manner that the rounded corners 38 will finally intersect along sharp, clear lines.

Figure 5:
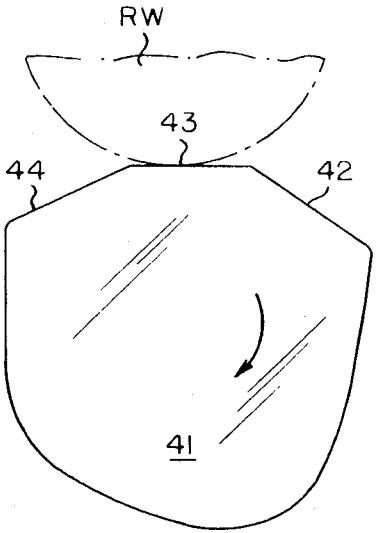
FIGS. 5, 6 and 7 are elevational views of a lens as it appears after each of the three edge grinding operations which have been performed thereon in accordance with one embodiment of applicant's three former system for producing multifaceted lenses.
Figure 6:
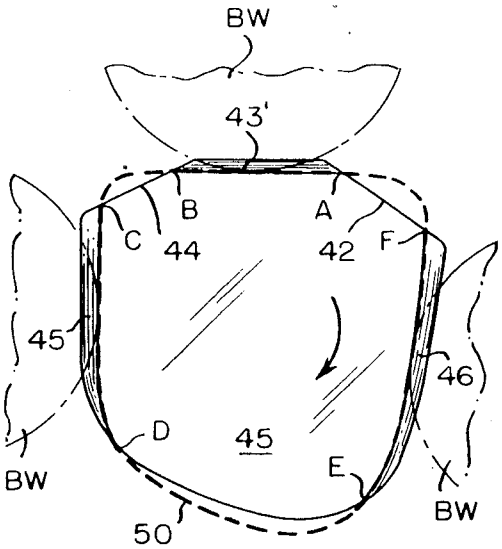
Figure 7:
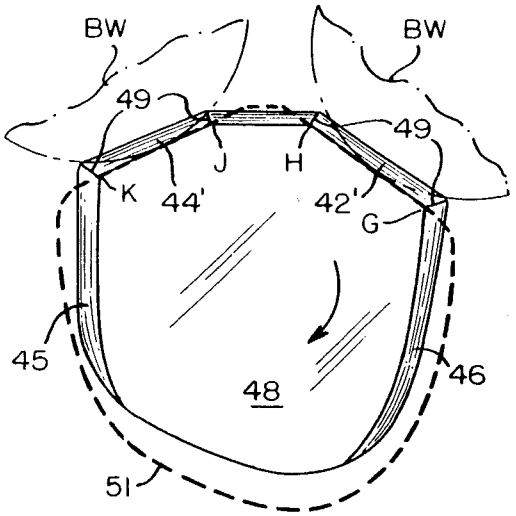

Referring now to FIGS. 5 to 7, applicant's novel process includes first the rough and finish grinding operations on the edge of the lens blank L with the wheel RW and the flat surface 28 on wheel BW to produce a ground lens 41 having the configuration as shown in FIG. 5. These steps, which are similar to that of the rough and finish grinding operations described above, form on the lens 41 along its upper edge three intersecting surfaces 42, 43, and 44. In practice the first pattern or former F used in these operations will be substantially identical in outer configuration to the ground lens 41.

After the rough and finish edge grinding operations, however, the bevel edge grinding operation is separated into two different steps or stages, as contrasted with the conventional single, continuous beveling operation which heretofore was customary; and for this purpose it is necessary to use an additional former F, the purpose of which will be noted hereinafter.

After lens 41 has been completed the first former F is replaced by a second former, which has a configuration as denoted by the broken lines at 50 in FIG. 6, and the bevel surface 29 on wheel BW is shifted into engagement with the lens 41. The first bevel grinding operation under control of the second former 50 then takes place, and the surface 29 on wheel BW grinds lens 41 into the configuration as denoted at 45 in FIG. 6. During this operation the wheel BW discontinuously engages the edge of the lens 45 to grind on its face three, spaced, beveled surfaces 43', 45 and 46, which lie between the points A-B, C-D and E-F, respectively. Except along these three surfaces, the wheel BW does not contact the edge of lens 45 during this first beveling operation. As shown in FIG. 6, for example, the edge of the lens is not bevel ground in those areas where the broken line 50 lies outside of the solid line representing the lens 45.

After this first beveling operation the former F is replaced by a third former, which has a configuration denoted by the broken lines at 51 in FIG. 7. The surface 29 on wheel BW is now used to grind the lens into its final configuration as denoted by numeral 48 in FIG. 7. During this operation wheel BW engages and bevel grinds the lens only in the two areas denoted in FIG. 7 between the letters G-H and J-K, respectively, thus forming on the lens beveled surfaces 42' and 44'. At other times during the revolution of lens 48 the wheel BW does not contact the lens; and in particular wheel BW never traverses directly from one flat, beveled section to the next adjacent section. As the result of skipping intermediate sections during each of the two successive beveling operations, the novel process results in the formation of extremely sharp corners or facets 49 at opposite ends of each of the intersecting suerfaces 42', 43' and 44' on the finished lens 48.

From the foregoing it will be apparent that the present invention provides a relatively simple and inexpensive method and means for readily eliminating the undesirable rounded corners or facets, which were heretofore formed on spectcale lenses when using the conventional two former system. By using three separate formers, and by grinding alternate beveled surfaces 43', 45 and 46 in one grinding operation, and then the intervening surfaces 42' and 44' in the next operation, no objectionable rounded corners are formed at opposite ends of the beveled sections of the lens. Simply by adding one additional bevel grinding phase, and by using two specially shaped formers 50 and 51, it has been possible to eliminate the tedious and time-consuming manual grinding which heretofore was necessary in order to provide multifaceted lenses of the type described.

Although the invention has been described in connection with the use of a compound flat-bevel wheel BW for performing the edge finishing and beveling operations, it will be appreciated that separate wheels could be used for these operations if desired. Moreover, although it has been suggested that the three surfaces 43', 45 and 46 be formed during the first bevel grinding stage, it will be apparent that the exact sequence of forming these surfaces (i.e. either in the first or second stage) is but a matter of choice. Moreover, although the intersecting surfaces 42, 43 and 44 appear as plane, flat surfaces, it will be apparent that their exact configurations could be different (e.g. concave, convex, etc.) provided adjacent such surfaces be formed by different stages of the bevel grinding operation so as to form sharp corners at their points of intersection.

While the invention has been illustrated and described in connection with only certain embodiments thereof, it will be understood that it is capable of still further modification, and that this application is intended to cover any such modifications as may fall within the scope of one skilled in the art, or the appended claims.

Having thus described my invention, what I claim is:

1. A method of edge grinding multifaceted lenses, comprising edge grinding a lens blank to a first configuration, bevel grinding a first plurality of spaced, beveled surfaces on the edge of the blank at spaced intervals around at least a portion of its periphery, and thereafter bevel grinding a beveled surface on the blank in each space between each adjacent air of said first plurality of surfaces, thereby to form on the blank a series of intersecting, beveled surfaces the intersections of which define a series of sharp corners or facets on the lens.

2. A method as defined in claim 1, including performing said grinding operations on a lens edger unit in which said lens blank revolves adjacent a bevel grinding wheel which is selectively engagable with said lens blank to grind said beveled surfaces thereon, and intermittently engaging said wheel with said blank first to grind thereon said first plurality of beveled surfaces, and then to grind thereon the remaining beveled surfaces in said series thereof.

3. A method as defined in claim 2, wherein the engagement of said bevel grinding wheel with said blank is controlled by a replaceable pattern that is removably mounted in said unit, and including mounting a first pattern in said unit for controlling said wheel during the grinding of said first plurality of beveled surfaces, and replacing said first pattern with a differently shaped pattern to control said wheel during the subsequent grinding of the remaining beveled surfaces in said series.

4. A method as defined in claim 2, wherein said edge gringing includes grinding at least three, intersecting edge ground surfaces on a portion of the edge of said blank, and said bevel grinding includes beveling each of said intersecting edge ground surfaces with said bevel grinding wheel, including momentarily disengaging said wheel from said blank after each of said intersecting edge ground surfaces has been beveled, and without interrupting the rotation of said blank.

5. A method of edge grinding multifaceted lenses in a lens edger unit having a rough grinding wheel and a bevel grinding wheel, comprising edge grinding a first plurality of intersecting surfaces on the edge of a lens blank with said rough grinding wheel, and intermittently engaging said bevel grinding wheel first with one and then with the other of an adjacent pair of said first plurality of intersecting surfaces thereby to bevel grind a pair of intersecting beveled surfaces on said blank, said bevel grinding step including completely disengaging said bevel grinding wheel from said blank after completion of the bevel grinding of said one of said adjacent surfaces, and then reengaging said bevel grinding wheel with said blank at a point angularly spaced from the point at which the bevel grinding wheel disengaged said blank to commence the bevel grinding of the other of said adjacent surfaces.

6. A method as defined in claim 5, including edge grinding said first plurality of intersecting surfaces on the edge of said blank with said rough grinding wheel being under the control of a first, removable pattern, substituting a second pattern for said first pattern and forming said beveled surface on said one of said adjacent surfaces with said bevel grinding wheel being under the control of said second pattern, and substituting a third pattern for said second pattern and forming said beveled surface on said other of said adjacent surfaces with said bevel grinding wheel being under the control of said third pattern.

7. A method as defined in claim 6, including rough grinding at least three of said first plurality of intersecting surfaces on the edge of said blank while said rough grinding wheel is under the control of said first pattern, grinding a bevel edge along at least one of said three surfaces while said bevel grinding wheel is under control of said second pattern, and bevel edge grinding the remainder of said three surfaces while said bevel grinding wheel is under the control of said third pattern.

8. A method as defined in claim 7, including disengaging said bevel edge grinding wheel from said blank and rotatably indexing said blank after the formation of each of said beveled surfaces.

* * * * *